US005098158A

United States Patent [19]

Palarski

[11] Patent Number: 5,098,158

[45] Date of Patent: * Mar. 24, 1992

[54] ARTICULATED RELAXATION CHAIR

[76] Inventor: Timothy D. Palarski, 2379 Briarwest, No. 138, Houston, Tex. 77077

[ * ] Notice: The portion of the term of this patent subsequent to Oct. 30, 2007 has been disclaimed.

[21] Appl. No.: 604,916

[22] Filed: Oct. 26, 1990

Related U.S. Application Data

[63] Continuation-in-part of Ser. No. 394,874, Aug. 17, 1989, Pat. No. 4,966,413.

[51] Int. Cl.[5] ..... A47C 1/02

[52] U.S. Cl. ..... 297/330; 297/284; 297/312

[58] Field of Search ..... 297/330, 312, 411, 284, 297/408, 434, 361

[56] References Cited

U.S. PATENT DOCUMENTS

| | | | |
|---|---|---|---|
| 2,684,708 | 7/1954 | Luketa | 297/330 X |
| 4,168,099 | 9/1979 | Jacobs et al. | 297/330 X |
| 4,173,372 | 11/1979 | Norris et al. | 297/330 X |
| 4,386,803 | 6/1983 | Gilderbloom | 297/330 X |
| 4,514,010 | 4/1985 | González | 297/284 |
| 4,521,053 | 6/1985 | Boer | 297/312 |
| 4,541,669 | 9/1985 | Göldner | 297/284 |
| 4,966,413 | 10/1990 | Palarski | 297/330 |

*Primary Examiner*—Peter A. Aschenbrenner

*Attorney, Agent, or Firm*—Kenneth A. Roddy

[57] ABSTRACT

An electrically operated relaxation chair has a floor engaging base, a padded seat-thigh rest member pivotally secured to the top of the base, and a padded back and head rest assembly pivotally secured to the top of the base at the rear of the seat-thigh rest. A calf rest is pivotally secured to the front of the seat-thigh rest. Padded arm rests are pivotally secured to each side of the back rest member. Controls in the arm rest control the operation of electric screw jack mechanisms to selectively move and position the seat-thigh rest, the calf rest, the back and head rest, and each arm rest relative to one another and to the base independently or as units. The arm rest members may have separate upper and forearm members pivotally connected and powered by electric screw jack mechanisms whereby the members pivot relative to one another and to the back and head rest assembly independently or as a unit. In one embodiment, the seat-thigh rest and calf rest members are a pair of laterally spaced left and right seat-thigh and calf support members pivotally connected and powered by electric screw jack mechanisms whereby the calf and seat-thigh support members pivot relative to one another and as units relative to the base. The head rest may be separate from the back rest to pivot relative thereto, and the back rest may have an expandable lumbar support.

18 Claims, 3 Drawing Sheets

FIG. 6
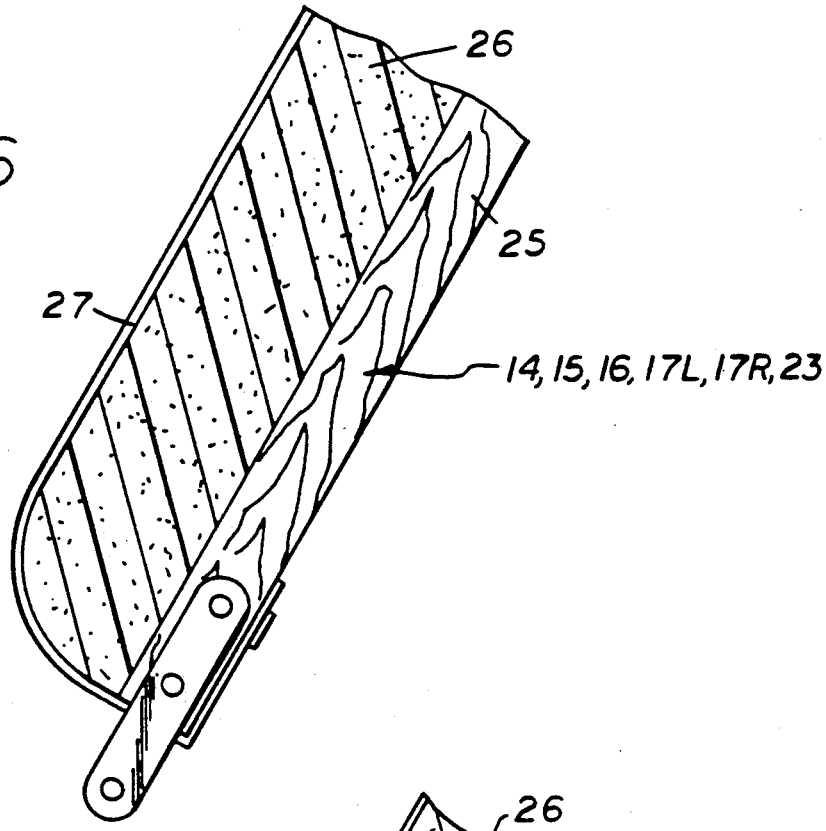
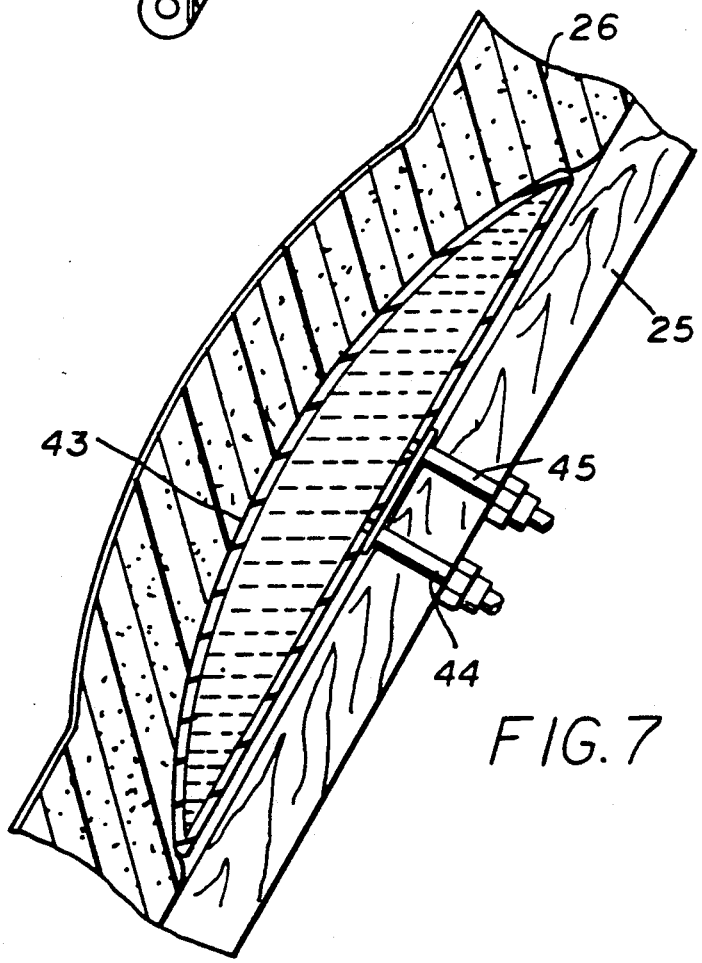
FIG. 7

ARTICULATED RELAXATION CHAIR

CROSS REFERENCE TO RELATED APPLICATION

This application is a continuation-in-part of co-pending application Ser. No. 07/394,874 filed 8-17-89, now U.S. Pat. No. 4,966,413.

BACKGROUND OF THE INVENTION

1. Field of the Invention

This invention relates generally to new and useful improvements in reclining chairs, and more particularly to an electrically controlled relaxation chair for home use having body support sections pivotally and selectively movable relative to each other closely corresponding to the joints of the human body.

2. Brief Description of the Prior Art

Recliner chairs controlled hydraulically or by electric motor and jack screw mechanisms are known in the art. Most power operated chairs of this type are medical chairs which have no arm rests and they are primarily intended to place the patient/occupant in a reclining position convenient to a doctor or dentist, thus they are not fully articulated for maximum comfort of the occupant, and are not particularly suited for home use. Most recliner chairs for home use are not power driven and provide only fixed upright, intermediate, and reclining positions. Other recliner chairs for home use which are power driven are substantially unitary "contour" chairs and do not provide any variations in supporting the limbs of the occupant.

Kleinsorge, U.S. Pat. No. 3,338,632 discloses a reclining chair primarily for use as a dental chair having an integral unitary seat and leg rest portion pivoted to a frame on a horizontal transverse axis adjacent the foot end. An integral unitary back and head rest portion is pivoted to the seat and leg rest portion. One hydraulic cylinder pivots the seat and leg rest portion relative to the frame and another hydraulic cylinder independently pivots the back and head rest portion relative to the seat and leg portion. This chair is intended primarily for use as a dental chair and no provision is made for arm rests, articulation of the thigh relative to the back, articulation of the calf relative to the thigh, or independent articulation of each leg.

Johnson, U.S. Pat. No. 3,934,928 discloses an adjustable reclining chair having a seat to which a back rest and a leg rest is pivotally connected. An electric motor and screw jack mechanism pivot the back rest and leg rest relative to the seat. This chair is also intended primarily for use as a medical chair and no provision is made for arm rests, articulation of the thigh relative to the back, or independent articulation of each leg.

Knabusch, U.S. Pat. No. 3,588,170 discloses recliner chair having a base frame to which a chair frame is tiltably mounted and on which a seat is supported for upward and forward movement as a pivoted back is moved rearwardly by a motor driven lead screw. Stationary arm rests are provided and control switches are mounted on the arm rests. No provision is made for articulation of the thigh relative to the back, articulation of the calf relative to the thigh, or independent articulation of each leg.

Simon, U.S. Pat. No. 1,527,754 discloses a mechanical chair designed to produce relaxation to the occupant. The chair has numerous support mechanisms which are manually adjusted and fixed in various positions to support the body either through its skeletal frame or through rugged body tissue.

The present invention is distinguished over the prior art in general, and these patents in particular by an electrically operated relaxation chair which has a floor engaging base, a padded seat-thigh rest member pivotally secured to the top of the base, and a padded back and head rest assembly pivotally secured to the top of the base at the rear of the seat-thigh rest. A calf rest is pivotally secured to the front of the seat-thigh rest. Padded arm rests are pivotally secured to each side of the back rest member. Controls in the arm rest control the operation of electric screw jack mechanisms to selectively move and position the seat-thigh rest, the calf rest, the back and head rest, and each arm rest relative to one another and to the base independently or as units. The arm rest members may have separate upper and forearm members pivotally connected and powered by electric screw jack mechanisms whereby the members pivot relative to one another and to the back and head rest assembly independently or as a unit. In one embodiment, the seat-thigh rest and calf rest members are a pair of laterally spaced left and right seat-thigh and calf support members pivotally connected and powered by electric screw jack mechanisms whereby the calf and seat-thigh support members pivot relative to one another and as units relative to the base. The head rest may be separate from the back rest to pivot relative thereto, and the back rest may have an expandable lumbar support.

SUMMARY OF THE INVENTION

It is therefore an object of the present invention to provide a relaxation chair for home use having body support sections pivotally and selectively movable relative to each other closely corresponding to the joints of the human body.

It is another object of this invention to provide a relaxation chair which is electrically operated and controlled by switches on the arm rest.

It is another object of this invention to provide a relaxation chair which allows selective positioning of the occupant's legs, back, and left and right arms relative to one another.

It is another object of this invention to provide a relaxation chair having a lumbar support which is selectively expanded or contracted to engage the lumbar portion of the back of the chair occupant.

It is another object of this invention to provide a relaxation chair with left and right arm rests which have separate upper arm and forearm support member which allows selective positioning of each forearm relative to the upper arm and each forearm and upper arm relative to the occupant's legs, back, and head.

It is another object of this invention to provide a relaxation chair which allows selective positioning of the occupant's calves relative to the thighs, and the thighs relative to the back, head, and left and right arms relative to one another.

It is another object of this invention to provide a relaxation chair having separate left and right leg rests which allows selective positioning of the occupant's left and right legs relative to each other and each leg relative to the back, head, and left and right arms.

It is another object of this invention to provide a relaxation chair having separate left and right thigh support members each of which has a calf support member which allows selective positioning of the occupant's left and right calves relative to the thighs, each thigh relative to each other and each thigh and calf relative to the back, head, and left and right arms.

A further object of this invention to provide a relaxation chair with left and right arm rests which have separate upper arm and forearm support members and separate left and right thigh support members which have calf support members which allows selective positioning of each forearm relative to the upper arm and each forearm and upper arm relative to the occupant's legs, back, and head and which also allows selective positioning of the occupant's left and right calves relative to the thighs, each thigh relative to each other and each thigh and calf relative to the back, head, and upper arms and forearms.

A still further object of this invention is to provide a relaxation chair which is simple in design and construction, economical to manufacture, and rugged and durable in use.

Other objects of the invention will become apparent from time to time throughout the specification and claims as hereinafter related.

The above noted objects and other objects of the invention are accomplished by an electrically operated relaxation chair which has a floor engaging base, a padded seat-thigh rest member pivotally secured to the top of the base, and a padded back and head rest assembly pivotally secured to the top of the base at the rear of the seat-thigh rest. A calf rest is pivotally secured to the front of the seat-thigh rest. Padded arm rests are pivotally secured to each side of the back rest member. Controls in the arm rest control the operation of electric screw jack mechanisms to selectively move and position the seat-thigh rest, the calf rest, the back and head rest, and each arm rest relative to one another and to the base independently or as units. The arm rest members may have separate upper and forearm members pivotally connected and powered by electric screw jack mechanisms whereby the members pivot relative to one another and to the back and head rest assembly independently or as a unit. In one embodiment, the seat-thigh rest and calf rest members are a pair of laterally spaced left and right seat-thigh and calf support members pivotally connected and powered by electric screw jack mechanisms whereby the calf and seat-thigh support members pivot relative to one another and as units relative to the base. The head rest may be separate from the back rest to pivot relative thereto, and the back rest may have an expandable lumbar support.

BRIEF DESCRIPTION OF THE DRAWINGS

FIG. 6 is a partial cross section through one of the padded members of the chair.

FIG. 7 is a partial cross section of the back support portion of the chair showing the lumbar support member.

DESCRIPTION OF THE PREFERRED EMBODIMENT

Figure 1:
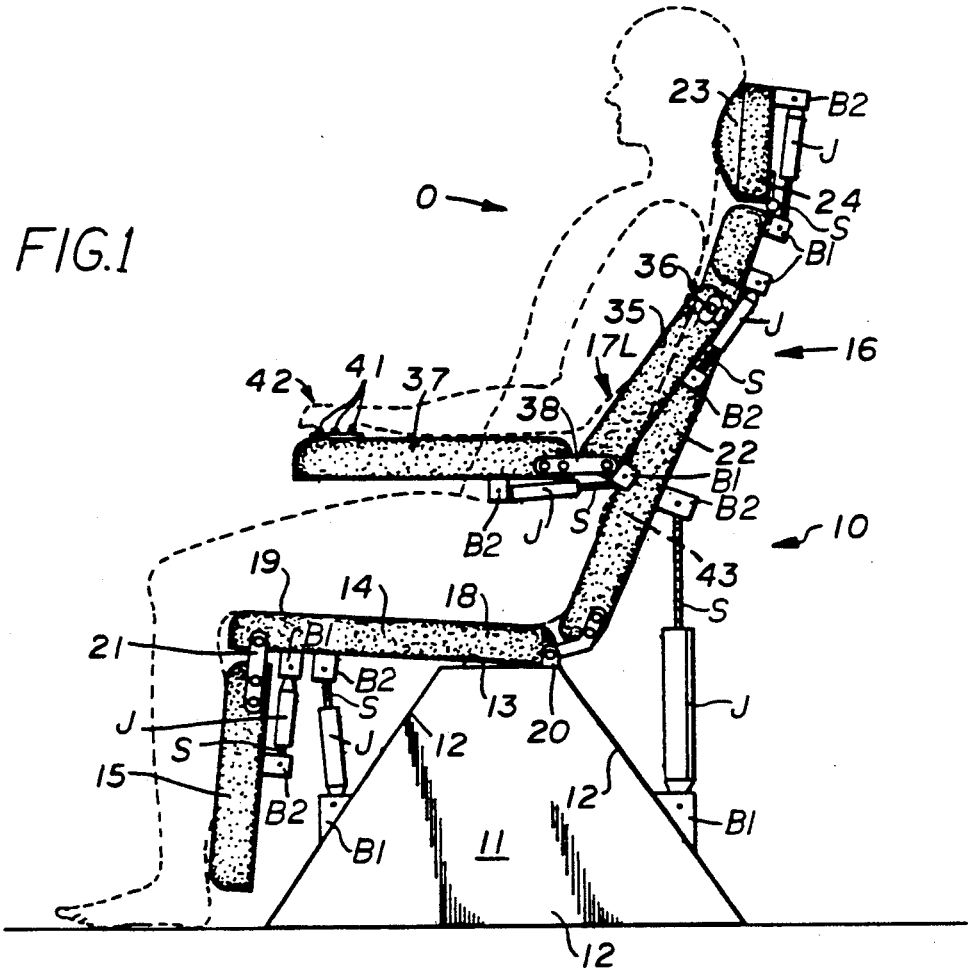
FIG. 1 is a side elevation of an articulated relaxation chair in accordance with the present invention shown in a generally upright position.
Figure 2:
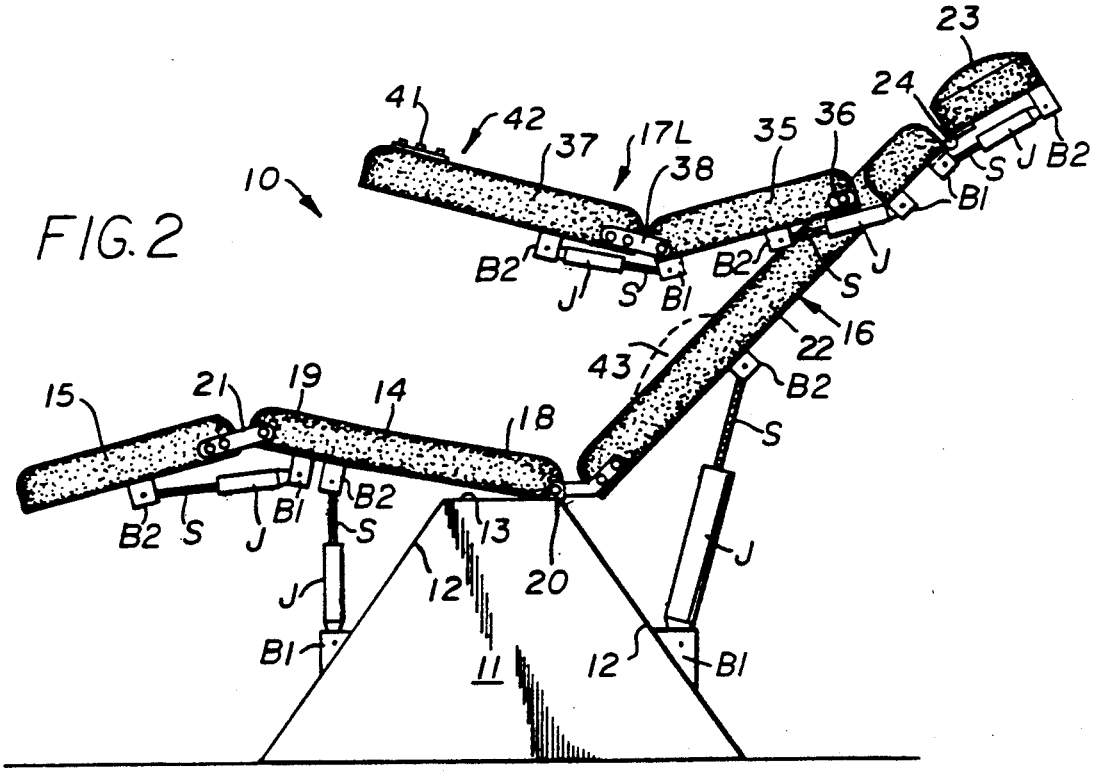
FIG. 2 is a side view of the articulated relaxation chair of FIG. 1 in a generally reclined position.
Figure 3:
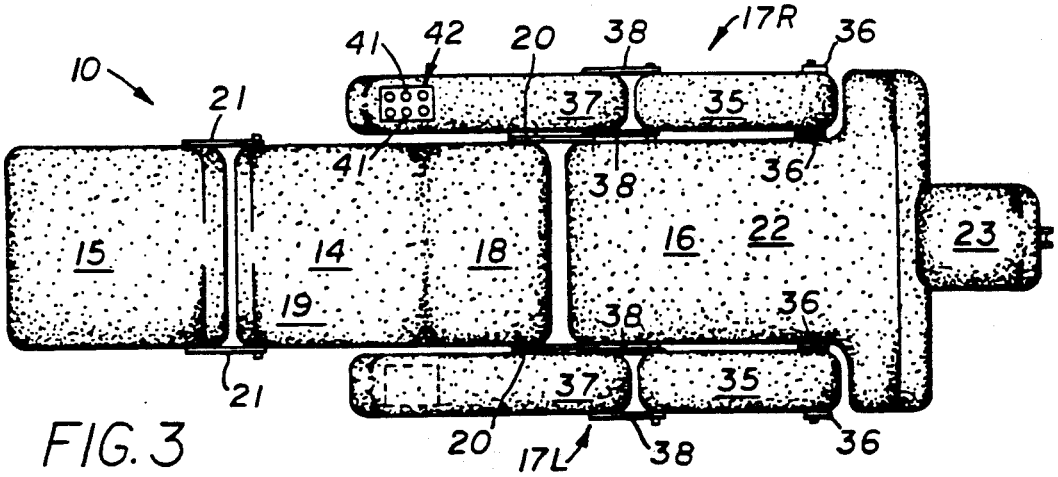
FIG. 3 is a top plan view of the articulated relaxation chair of FIG. 2.

Referring to the drawings by numerals of reference, there is shown in FIGS. 1-3, a preferred articulated relaxation chair 10. The relaxation chair 10 comprises a base 11 which rests on the floor. The base 11 is a hollow box-like member having four side walls 12 and a top wall 13. The bottom end of the base 11 may be open or enclosed by a bottom wall. The bottom portion of the base extends laterally outward beyond the top portion to provide stability against tipping over.

A seat-thigh rest 14 is pivotally secured to the top wall 13 of the base 11. A calf rest 15 is pivotally secured to the forward end of the seat-thigh rest 14. A back and head rest assembly 16 is pivotally secured to the top wall 13 of the base 11 at the rearward end of the seat-thigh rest 14. A pair of left and right arm rest assemblies 17L and 17R are pivotally connected one at each lateral side edge of the back and head rest assembly near its upper end.

The seat-thigh rest 14 has a seat support portion 18 at its rearward end for supporting the buttocks of the occupant O and a generally rectangular thigh support portion 19 adjoining the seat support portion and extending forward therefrom for supporting the thighs of the occupant. The seat-thigh rest 14 is pivotally secured to the top wall 13 of the base 11 by a pair of hinge brackets 20 at each side of the rearward end of the seat support portion 18 for vertical pivotal movement of the seat-thigh rest 14 relative to the base.

The generally rectangular calf support portion 15 is pivotally connected at its rearward end to the forward end of the thigh support portion 19 of the seat thigh rest 14 by a hinge bracket 21 at each side thereof for vertical pivotal movement relative thereto.

The back and head rest assembly 16 has a generally rectangular back support member 22 of sufficient size and shape to support the back and shoulders of the chair occupant O and is pivotally secured at its bottom end to the top wall 13 of the base 11 adjacent the rear portion of the seat-thigh rest 14 by the hinge brackets 20 at each side of the rearward end of the seat support portion 18 for vertical pivotal movement of the back and head rest assembly 16 relative to the base 11 and to the seat-thigh rest.

The back and head rest assembly 16 includes a separate generally square or rectangular head support member 23 pivotally connected at its bottom end to the top end of the back support member 22 by a hinge 24 for vertical pivotal movement relative thereto.

As shown in FIG. 6, the seat-thigh rest 14, calf support member 15, back and head rest 16, arm rests 17L and 17R, and head support member 23 are formed of a generally rectangular rigid backing plate 25 having its upper surface covered with suitable padding 26 and upholstery 27.

In the following description of the screw jack mechanisms shown in FIGS. 1, 2, and 5, it should be understood that each of the mechanisms designated as J is a conventional screw jack having a housing which contains a gear nut rotatably engaged with a worm gear operatively connected to a reversible electric motor. A threaded shaft S is threadedly engaged with the gear nut and extends from the housing. The electric motor is connected to a source of electrical power and is operated by switches contained in a control panel or box. When the motor is energized, the gear nut is rotated causing the shaft to extend or retract relative to the housing depending upon the direction of rotation. To avoid unnecessary repetition and excessive numbering, the screw jack mechanisms will be designated as J and the shaft as S.

A mounting bracket B1 is affixed to the forward wall of the base 11 and a mounting bracket B2 is affixed to the underside of the seat-thigh rest 14 intermediate its side edges. One end of a screw jack mechanism J is pivotally mounted in the bracket B1 and the extended end of the screw jack threaded shaft S is secured in the bracket B2. The electric motor contained in the screw jack J is reversible whereby the seat-thigh rest 14 and calf support member 15 may be vertically pivoted as a unit relative to the base 11 and the back and head rest assembly 16.

A mounting bracket B1 is affixed to the underside of the seat-thigh rest 14 near its forward end and another mounting bracket B2 is affixed to the underside of the calf support member 15 intermediate their side edges. One end of a screw jack mechanism J is pivotally mounted in the bracket B1 and the extended end of the screw jack threaded shaft S is secured in the bracket B2. The electric motor contained in the screw jack J is reversible whereby the calf member 15 may be vertically pivoted relative to the seat-thigh rest 14. As described above, the calf support member 15 and seat-thigh rest 14 may also be pivoted as a unit relative to the base 11 and to the back and head rest assembly 16.

A mounting bracket B1 is affixed to the rearward wall of the base 11 and a mounting bracket B2 is affixed to the underside of the back and head rest assembly 16 intermediate its side edges. One end of a screw jack mechanism J is pivotally mounted in the bracket B1 and the extended end of the screw jack threaded shaft S is secured in the bracket B2. The electric motor contained in the screw jack J is reversible whereby the back and head rest assembly 16 may be vertically pivoted relative to the base 11 and the to seat-thigh rest 14.

A mounting bracket B1 is affixed to the underside of the back support member 22 of the back and head support assembly 16 near its upper end and another mounting bracket B2 is affixed to the underside of the head support member 23 intermediate their side edges. One end of a screw jack mechanism J is pivotally mounted in the bracket B2 and the extended end of the screw jack threaded shaft S is secured in the bracket B1. The electric motor contained in the screw jack J is reversible whereby the head support member 23 may be vertically pivoted relative to the back support member 22. The head support member 23 and back support member 22 may also be pivoted as a unit relative to the base 11 and to the seat-thigh rest 14.

Each arm rest assembly 17L and 17R has a generally rectangular upper arm support member 35 pivotally connected at its rearward end to the lateral edge of the back support member 22 by a pair of hinge brackets 36 for vertical pivotal movement relative thereto. Each arm rest assembly 17L and 17R has a generally rectangular forearm support member 37 pivotally connected at its rearward end to the forward end of the upper arm support member 35 by a hinge bracket 38 at each lateral side of the adjacent members for vertical pivotal movement relative to the upper arm member 35. The arm rest assemblies 17L and 17R including the upper and forearm support portions 35 and 37 are formed of a generally rectangular rigid backing plate 25 having its upper surface covered with suitable padding 26 and upholstery 27 (FIG. 6).

A pair of mounting brackets B1 are affixed one near each lateral side edge of the back support member 22 near the shoulder area and another mounting bracket B2 is affixed to the underside of each upper arm support member 35 intermediate its side edges. One end of a screw jack mechanism J is pivotally mounted in the brackets B1 and the extended end of the screw jack threaded shafts S are secured in the brackets B2. The electric motor contained in the screw jack J is reversible whereby the upper arm portions 35 of the arm rest assemblies 17L and 17R may be vertically pivoted relative to the back and head rest assembly 16.

A mounting bracket B1 is affixed to the underside of each upper arm member 35 near its forward end and another mounting bracket B2 is affixed to the underside of each forearm member 37 intermediate their lateral side edges. One end of a screw jack mechanism J is pivotally mounted in the brackets B2 and the extended end of the screw jack threaded shafts S are secured in the brackets B1. The electric motor contained in the screw jack J is reversible whereby the forearm members 37 of the arm rest assemblies 17L and 17R may be vertically pivoted independently relative to the upper arm members 35 and the back support member 22. Each forearm member 37 and upper arm member 35 may also be pivoted as a unit relative to the back support member 22.

The electric motor of the screw jack mechanisms J is connected to a source of electrical power (not shown) and is operated by switches contained in a control panel or box which may be housed in the base 11, or could be placed in another enclosure remote from the base. Preferably, control switches or buttons 41 on a control panel 42 are mounted at the forward end of one or both of the forearm members 37 of the arm rest assemblies within easy access to the chair occupant.

As best seen in FIG. 7, a fluid expandable lumbar support member 43 may be installed in the lumbar area the back support portion 22 between the rigid backing plate 25 and the padding 26. The lumbar support 43 is a hollow bladder-like construction formed of rubber or other suitable expandable material and has fluid inlet and outlet conduits 44 and 45 connected a fluid power unit and is selectively fluid expanded or contracted by a switch or button 41 on the control panel 42.

Figure 4:
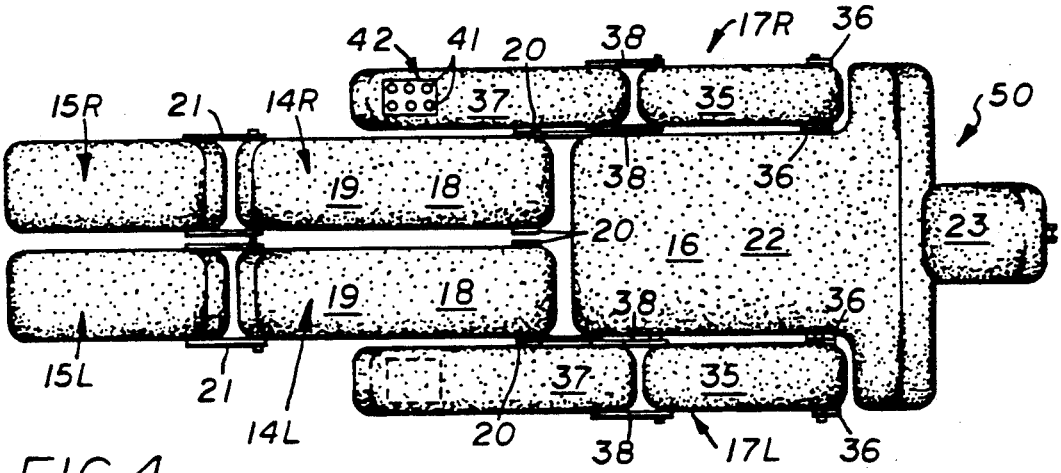
FIG. 4 is a top plan view of an articulated relaxation chair having separate laterally spaced seat-thigh rest and calf rest members in accordance with the present invention.
Figure 5:
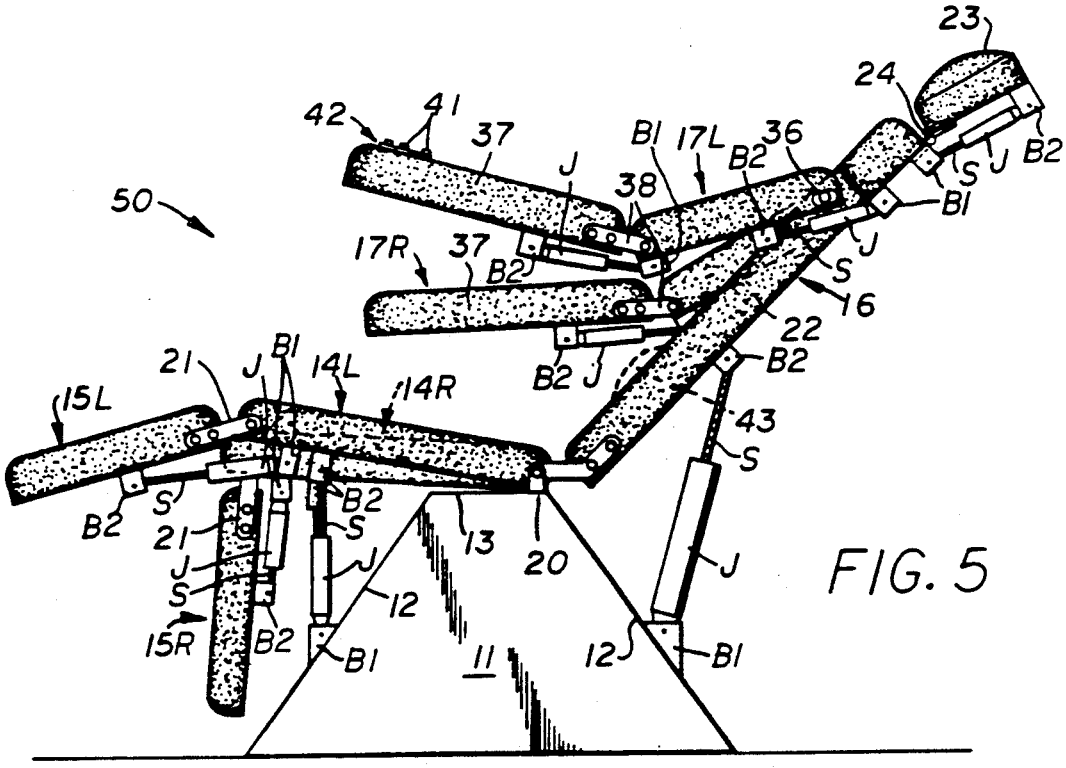
FIG. 5 is a side elevation of the articulated relaxation chair of FIG. 4 with each seat-thigh rest, calf rest, and arm rest members in different positions.

FIGS. 4 and 5 show a modification of the relaxation chair 50 which has separate, laterally spaced seat-thigh rests and calf support members. The other components of the chair are substantially the same as previously described and are assigned the same numerals of reference, but their description will not be repeated to avoid repetition.

The relaxation chair 50 has the same base 11, back and head rest assembly 16 pivotally secured to the base top wall 13, and arm rest assemblies 17L and 17R pivotally secured at the lateral side edges of the back and head rest assembly as previously described.

The chair 50 has two separate laterally spaced left and right seat-thigh rests 14L and 14R each having a seat support portion 18 and a generally rectangular thigh support portion 19 extending forwardly therefrom. The rearward end of each seat support portion 18 of the seat-thigh rests 14L and 14R is pivotally secured at its rearward end to the top wall 13 of the base 11 by a pair of hinge brackets 20 one to each side of the lateral edges for independent vertical movement of each seat-thigh rest 14L and 14R relative to each other and to the base 11 for vertical pivotal movement relative thereto. Each seat-thigh rest has a generally rectangular calf support member 15L and 15R pivotally connected at its rearward end to the forward end of the thigh support portion 19 by a hinge bracket 21 for independent vertical pivotal movement relative thereto. As previously described, the seat-thigh support members and calf support members are formed of a generally rectangular rigid backing plate having its upper surface covered with suitable padding and upholstery.

A pair of laterally spaced mounting brackets B1 are affixed to the forward wall of the base 11 and a mounting bracket B2 is affixed to the underside of each seat-thigh rest 14L and 14R intermediate their lateral side edges. One end of a screw jack mechanism J is pivotally mounted in the brackets B1 and the extended end of the screw jack threaded shafts S are secured in the brackets B2. The electric motor contained in the screw jack J is reversible whereby each seat-thigh rest 14L, 14R and calf support member 15L, 15R may be vertically pivoted as a unit relative to one another and to the base 11 and the back and head rest assembly 16.

A mounting bracket B1 is affixed to the underside of each seat-thigh rest 14L and 14R near its forward end and another mounting bracket B2 is affixed to the underside of each calf support member 15L and 15R intermediate their side edges. One end of a screw jack mechanism J is pivotally mounted in the brackets B1 and the extended end of the screw jack threaded shafts S are secured in the brackets B2. The electric motor contained in the screw jack J is reversible whereby each calf member 15L and 15R may be independently vertically pivoted relative to one another and to the seat-thigh rest 14L and 14R. The calf support members 15L and 15R may be pivoted with the seat-thigh rests as a unit relative to the base 11 and the back and head rest assembly 16.

An expandable lumbar support member 43 as previously described may be installed in the lumbar area of the back support portion 22 between the backing plate 25 and the padding 26.

It should be understood that the preferred embodiments described herein may utilize either a central motor or a motor for each screw jack mechanism, and that extension and retraction of the screw jack mechanism may be accomplished by rotating either the nut or the shaft relative while maintaining the other member stationary.

OPERATION

In use the occupant may use the chair in a upright sitting position as shown in FIG. 1, or in a variable selective variety of positions. By operating the buttons on the control panel, the occupant may operate the back and head rest assembly as a unit relative to the seat-thigh rest and calf rest, and may move the head rest independently of the back rest member of the back and head rest assembly.

The occupant may also move the left and right arm rests independently relative to one another and to the back and head rest assembly. The left and right forearm members of the arm rests may be moved independently relative to the upper arm portions.

In the embodiment of FIG. 1, the occupant may also move the seat-thigh rest and calf support member as a unit relative to the back and head rest. The calf support may also be moved independently relative to the seat-thigh rest. With the back and head rest assembly in a reclining position, the seat-thigh rest may be raised to a position to elevate the legs of the occupant above the heart which is useful for persons with a heart or circulatory condition.

In the embodiment of FIGS. 4 and 5, the occupant may also move the left or right seat-thigh rests and calf rests as a unit relative to the back and head rest. Each left and right calf support member may also be moved independently relative to each seat-thigh member. In this embodiment, it is possible to move the occupant's left and right legs relative to one another and to the back and head and to the left and right arms, and to further move the left and right calves relative to the thighs and the left and right forearms relative to the upper arm.

Thus, the present electrically controlled relaxation chair is a significant improvement over conventional recliners and medical chairs in that it has body support sections pivotally and selectively movable relative to each other closely corresponding to the joints of the human body to provide a wide range of comfortable and therapeutic positions.

While this invention has been described fully and completely with special emphasis upon several preferred embodiments, it should be understood that within the scope of the appended claims the invention may be practiced otherwise than as specifically described herein.

I claim:

1. An articulated relaxation chair comprising;

a floor engaging base, leg rest means pivotally secured to said base for vertical pivotal movement relative thereto including a seat-thigh support member having a seat support portion at its rearward end for supporting the buttocks of the chair occupant and a thigh support portion extending forwardly therefrom for supporting the thighs of the occupant, and a calf support member pivotally secured at its rearward end to the forward end of said thigh portion for vertical pivotal movement relative thereto, reversible drive means secured between said leg rest means and said base for pivotally moving said leg rest means relative to said base, reversible drive means secured between said calf support member and said seat-thigh support member for pivotally moving said calf support portion relative to said thigh support portion, back rest means pivotally secured to said base at the rearward end of said leg rest means for vertical pivotal movement relative thereto, reversible drive means secured between said back rest means and said base for pivotally moving said back rest means relative to said leg rest means and said base, each said reversible drive means connected to a source of power for driving same, and selective control means operatively connected with said reversible drive means for selectively controlling the movement of each said reversible drive means independently to provide the occupant with selective positioning of said calf support portion, said thigh support portion, and said back rest means relative to on another and to said base.

2. An articulated relaxation chair according to claim 1 in which;

said back rest means has a back support portion for supporting the back of the occupant and a head rest portion for supporting the head of the occupant.

3. An articulated relaxation chair according to claim 1 including;

left and right arm rest means pivotally secured at each lateral side of said back rest means for independent vertical pivotal movement relative thereto, reversible drive means secured between said left and right arm rest means and said back rest means for pivotally moving each said arm rest means independently relative to said back rest means, and selective control means on said arm rest means for selectively controlling the movement of each said reversible drive means independently to provide the occupant with selective positioning of said leg rest means, said back rest means, and said left and right arm rest means relative to one another and to said base.

4. An articulated relaxation chair according to claim 1 in which;

said reversible drive means comprise one or more screw jack assemblies, said power means comprises a reversible electric motor operatively connected with said drive means, and said control means comprises a series of switches for reversibly operating said motor to extend and retract said screw jack assemblies.

5. An articulated relaxation chair according to claim 1 including;

selectively adjustable lumbar support means disposed in said back rest means and operatively connected to a source of fluid and controlled by lumbar control means for selectively engaging the lumbar portion of the back of the chair occupant.

6. An articulated relaxation chair according to claim 5 in which;

said lumbar support means comprises a fluid expandable bladder construction, and said control means comprises a series of switches for reversibly conducting said fluid to and from said lumbar support means to expand or collapse same.

7. An articulated relaxation chair according to claim 1 in which;

said leg rest means comprises a pair of separate elongate, laterally spaced, left and right leg support members each pivotally secured at their rearward end to said base for independent vertical pivotal movement relative thereto, and said reversible drive means is operatively secured between each said leg support member and said base for pivotally moving each said left and right leg support member independently, whereby the occupant is provided with selective independent positioning of each said left and right leg support member relative to one another and relative to said back and head rest means, said left and right arm rest means, and said base.

8. An articulated relaxation chair comprising;

a floor engaging base, leg rest means pivotally secured to said base for vertical pivotal movement relative thereto including a seat-thigh support member having a seat support portion at its rearward end for supporting the buttocks of the chair occupant and a thigh support portion extending forwardly therefrom for supporting the thighs of the occupant, and a calf support member pivotally secured at its rearward end to the forward end of said thigh portion for vertical pivotal movement relative thereto, reversible drive means secured between said leg rest means and said base for pivotally moving said leg rest means relative to said base, reversible drive means secured between said calf support member and said seat-thigh support member for pivotally moving said calf support portion relative to said thigh support portion, back and head rest means pivotally secured to said base adjacent the rearward end of said leg rest means for vertical pivotal movement relative thereto, reversible drive means secured between said back and head rest means and said base for pivotally moving said back and head rest means relative to said leg rest means and said base, left and right arm rest means pivotally secured at each lateral side of said back and head rest means for independent vertical pivotal movement relative thereto, reversible drive means secured between said left and right arm rest means and said back and head rest means for pivotally moving each said arm rest means independently relative to said back and head rest means, each said reversible drive means operatively connected to a source of power for driving same, and selective control means operatively connected with said reversible drive means for selectively controlling the movement of each said reversible drive means independently to provide the occupant with selective positioning of said calf support portion, said thigh support portion, said back and head rest means, and said left and right arm rest means relative to one another and to said base.

9. An articulated relaxation chair according to claim 8 in which;

said reversible drive means comprise one or more screw jack assemblies, said power means comprises a reversible electric motor operatively connected with said drive means, and said control means comprises a series of switches for reversibly operating said motor to extend and retract said screw jack assemblies.

10. An articulated relaxation chair according to claim 8 including;

selectively adjustable lumbar support means disposed in said back rest means and operatively connected to a source of fluid and controlled by lumbar control means for selectively engaging the lumbar portion of the back of the chair occupant.

11. An articulated relaxation chair according to claim 10 in which;

said lumbar support means comprises a fluid expandable bladder construction, and said control means comprises a series of switches for reversibly conducting said fluid to and from said lumbar support means to expand or collapse same.

12. An articulated relaxation chair according to claim 8 in which;

said leg rest means comprises a pair of separate elongate, laterally spaced, left and right leg support members each pivotally secured at their rearward end to said base for independent vertical pivotal movement relative thereto, and said reversible drive means is operatively secured between each said leg support member and said base for pivotally moving each said left and right leg support member independently, whereby the occupant is provided with selective independent positioning of each said left and right leg support member relative to one another and relative to said back and head rest means, said left and right arm rest means, and said base.

13. An articulated relaxation chair according to claim 8 in which;

each said left and right arm rest means comprises a generally rectangular upper arm support member pivotally secured at its rearward end to one side of said back and head rest means for vertical pivotal movement relative thereto, and a generally rectangular forearm support member pivotally secured at its rearward end to the forward end of said upper arm support member for vertical pivotal movement relative thereto, and further including reversible drive means secured between said forearm support member and said upper arm support member and operatively connected to said power means and said control means for pivotally moving said forearm support member relative to said upper arm support member, whereby the chair occupant is provided with selective independent positioning of said each forearm support member relative to said upper arm support member, said back and head rest means, said leg rest means, and said base.

14. An articulated relaxation chair according to claim 8 in which;

said back and head rest means comprises a back support member pivotally secured at its lower end to said base adjacent the rearward end of said leg rest means for vertical pivotal movement relative thereto, and a head support member pivotally secured at the upper end of said back support member for vertical pivotal movement relative thereto, and further including reversible drive means secured between said head support member and said back support member and operatively connected to said power means and said control means for pivotally moving said head support member relative to said back support member, whereby the chair occupant is provided with selective independent positioning of said head support member relative to said back support member, said leg rest means, said left and right arm rest means, and said base.

15. An articulated relaxation chair according to claim 8 in which;

said leg rest means comprises a pair of separate elongate, laterally spaced, left and right leg support members each pivotally secured at their rearward end to said base for independent vertical pivotal movement relative thereto, each said left and right leg support member pivotally secured at its rearward end to said base for vertical pivotal movement relative thereto, and a calf support member pivotally secured at its rearward end to the forward end of each leg support member for vertical pivotal movement relative thereto, and further including reversible drive means secured between each said left and right leg support member and said base and between each said left and right leg support member and each said calf support member and operatively connected to said power means and said control means for pivotally moving each said left and right leg support member and said calf support member relative to one another and to said base and each said calf support member relative to said each said left and right leg rest member, whereby the occupant is provided with selective independent positioning of each said calf support member relative to each said left and right leg support member and as a unit with each said left and right leg support member relative to one another and to said back and head rest means, said left and right arm rest means, and said base.

16. An articulated relaxation chair according to claim 8 in which;

said leg rest means comprises a generally rectangular seat-thigh support member having a seat support portion at its rearward end for supporting the buttocks of the chair occupant and a thigh support portion extending forwardly therefrom for supporting the thighs of the chair occupant and a calf support member pivotally secured at its rearward end to the forward end of said thigh support portion for vertical pivotal movement relative the thigh support portion, said seat-thigh support member pivotally secured at its rearward end to base for vertical pivotal movement relative thereto, said first stated reversible drive means secured between said thigh support portion of said leg rest member and said base and between said thigh support portion and said calf support member for moving said seat-thigh member relative to said base and said calf support member relative to said seat-thigh support member, said back and head rest means comprises a back support member pivotally secured at its lower end to said base adjacent the rearward end of the seat support portion of said seat-thigh support member for vertical pivotal movement relative thereto and a head support member pivotally secured at the upper end of said back support member for vertical pivotal movement relative thereto, said second stated reversible drive means secured between said back rest member and said base and between said back rest member and said head rest member for pivotally moving said back rest member relative to said seat-thigh support member and said head support member relative to said back support member, each said arm rest means comprises a generally rectangular upper arm support member pivotally secured at its rearward end to one side of said back support member for vertical pivotal movement relative thereto and a generally rectangular forearm support member pivotally secured at its rearward end to the forward end of said upper arm support member for vertical pivotal movement relative thereto, said third stated reversible drive means secured between each said upper arm support member and said back rest member and between each said forearm support member and said upper arm support member for pivotally moving said upper arm support member relative to said back rest member and said forearm support member relative to said upper arm support member, said selective control means on said arm rest means comprises a series of switches operatively connected to said reversible drive means and said power means for selectively controlling the movement of each said reversible drive means independently, whereby the occupant is provided with selective independent positioning of said leg rest means, said back and head rest means, and said left and right arm rest means each as a unit relative to one another and to said base, and with selective independent positioning of said calf support member, said seat-thigh support member, said back support member, said head rest member, each said upper arm member, and each said forearm member each relative to one another.

17. An articulated relaxation chair according to claim 16 in which;

said seat-thigh support member comprises a pair of separate laterally spaced left and right seat-thigh support members each having a seat support portion at its rearward end and a thigh support portion extending forwardly therefrom for supporting the left and right thighs of the chair occupant and each pivotally secured at their rearward end to said base for independent vertical pivotal movement relative thereto and each having a calf support member pivotally secured at its rearward end to the forward end of each said thigh portion for vertical pivotal movement relative thereto, and said first stated reversible drive means secured between each said seat-thigh support member and said base and between each said seat-thigh support member and each calf support member and operatively connected to said power means and said control means for pivotally moving each said left and right seat-thigh support member relative to one another and each said calf support member relative to each said seat-thigh support member, whereby the occupant is provided with selective independent positioning of each said left and right seat-thigh support member, said back and head rest member, and said arm support members each as a unit relative to one another and to said base, and with selective independent positioning of each said calf support member, each said seat-thigh support member, said back support member, said head rest member, each said upper arm portion, and each said forearm portion each relative to one another.

18. An articulated relaxation chair according to claim 16 including;

selectively adjustable lumbar support means disposed in said back support portion and operatively connected to said power means and controlled by said control means for selectively engaging the lumbar portion of the back of the chair occupant.

* * * * *